US006486763B1

(12) United States Patent
Kummel

(10) Patent No.: US 6,486,763 B1
(45) Date of Patent: Nov. 26, 2002

(54) INDUCTIVE COMPONENT AND METHOD FOR MAKING SAME

(75) Inventor: Jean-François Kummel, Thionville (FR)

(73) Assignee: Microspire, Illange (FR)

( * ) Notice: Subject to any disclaimer, the term of this patent is extended or adjusted under 35 U.S.C. 154(b) by 0 days.

(21) Appl. No.: 09/509,747

(22) PCT Filed: Oct. 1, 1997

(86) PCT No.: PCT/FR97/01727

§ 371 (c)(1),
(2), (4) Date: Mar. 30, 2000

(87) PCT Pub. No.: WO99/17318

PCT Pub. Date: Apr. 8, 1999

(51) Int. Cl.[7] ..... H01F 27/02

(52) U.S. Cl. ..... 336/96; 336/90; 336/192; 336/198

(58) Field of Search ..... 336/90, 198, 192, 336/200, 232, 223, 212, 96

(56) References Cited

U.S. PATENT DOCUMENTS 4,553,123 A 11/1985 Tamada et al.

6,204,744 B1 * 3/2001 Shafer et al. ..... 336/83

FOREIGN PATENT DOCUMENTS

| | | | |
|---|---|---|---|
| DE | 195 44 915 A1 | | 12/1995 |
| DE | 196 28 897 A1 | | 7/1996 |
| EP | 0 741 396 A1 | | 11/1996 |
| JP | 04338617 | | 11/1992 |
| JP | 5-277761 | * | 8/1993 |
| JP | 5-217761 | * | 9/1993 |

* cited by examiner

*Primary Examiner*—Lincoln Donovan
*Assistant Examiner*—Tuyen T. Nguyen
(74) *Attorney, Agent, or Firm*—Boyle Fredrickson Newholm Stein & Gratz S.C.

(57) ABSTRACT

An inductive component intended to be installed on a printed circuit includes at least one winding, a body, and a magnetic core. The winding is made of an electrically conductive wire wound to form a flat coil the ends of which are connected to the inner ends of connecting terminals. The body is formed from a block of insulating material overmoulded onto the coil and onto the said inner ends of the terminals, the body including a central opening which passes through the body along the axis of the coil. The magnetic core is made of a ferrite layer that surrounds the body in a center plane containing the axis of the coil. A center element passes through the opening in the body.

7 Claims, 4 Drawing Sheets

INDUCTIVE COMPONENT AND METHOD FOR MAKING SAME

RELATED APPLICATIONS

This application is a 371 of PCT/FR97/01727 filed Oct. 1, 1997.

BACKGROUND OF THE INVENTION

1. Field of the Invention

This invention concerns inductive components, of the type including one or more windings, and which can be used therefore depending on case as inductors or alternating current transformers. Such components, as inductors, are generally used to perform in electric or electronic circuits the filtering, smoothing or energy storage functions, being conventionally traversed by currents with a DC component on which an AC component is superimposed. A current operating frequency range is 10 kHz to 3 MHz. Such components are for instance currently used in switched power supplies or DC converters. Also, these components are conventionally made so that they can be installed on printed circuits in a manner known itself.

2. Description of the Related Art

Known inductors of the type mentioned above generally consist of one or more enameled copper wire windings made on a toroidal core supported by a base including connecting pins. Conventionally, especially to reduce the overall surface area on the printed circuit, the toroidal windings are arranged vertically on the base so as to extend perpendicularly to the surface of the printed circuit. The ends of the wires are connected to the connecting pins or themselves form the said pins which are intended to be inserted into holes drilled in the printed circuit or soldered to it in a conventional manner. Although it is possible to also adopt a surface-mounted component (SMC) type design which is more suited to automatic installation, the high volume and weight of these components generally prohibits such a design and these components must be mounted manually on the printed circuit before soldering. Also, the mechanical strength in cases of strong vibrations is not very reliable on account of the high weight and the relative distance of the core from the printed circuit when compared with the relatively small dimensions of the base.

Moreover, the magnetic materials used for the toroidal core are generally iron powder based, for example, iron-silicon, when the planned operating frequencies are low, up to 100 kHz, or when the frequencies are higher, up to 200 kHz, made of a ferronickel alloy such as permalloy, for instance the material currently known under the name of Moly-Permalloy or MPP, which is a sintered iron and nickel powder with 80 or 50% nickel.

These two materials have the advantage of supporting a high DC magnetic field which enables the section of the core, and therefore the overall size of the component to be reduced.

However, their losses are high when used at high frequencies, that is around several hundred kHz to several MHz and therefore are poorly suited to uses such as in converter switching power supply circuits which increasingly use very high frequencies.

Another disadvantage of toroidal-type windings is that they are not sealed, the wire being simply wound around the toroidal core without external protection.

OBJECTS AND SUMMARY OF THE INVENTION

The purpose of this invention is to solve these problems and especially aims at supplying an inductive component with a low weight and a low volume, limiting the losses when used at high frequencies and where installation can be facilitated and automated by authorizing the design of these components as surface-mounted components (SMC).

With these targets in mind, the subject of the invention is an inductive component intended to be installed on a printed circuit and including at least one winding consisting of an electrically conductive wire and a magnetic core, characterized in that:

- the winding consists of a conductive wire wound in the form of a flat coil the ends of which are connected to the inner ends of the connecting terminals,
- a body, formed of a block of insulating material with a lower face more or less orthogonal to the axis of the coil, is overmoulded on the coil and on the said inner ends of the terminals, the body including a central opening which passes through it along the axis of the coil,
- the core is made of ferrite and surrounds the body in the centre plane containing the axis of the coil and has a centre element passing through the opening of the body.

The combination of characteristics according to the invention especially has the advantage of providing a significant gain in volume and in weight when compared with inductive components with equivalent properties made in the form of toroidal core inductors: a component according to the invention takes up, for instance, a volume of 1200 $mm^3$ whereas an equivalent inductor with a toroidal core takes up a volume of around 3240 $mm^3$. These advantages result especially from the use of a winding with a low height and of a ferrite magnetic core which, thanks to its magnetic characteristics, enables a reduction in the section. Ferrites have low losses at high frequencies and such a material is therefore especially suitable for the applications targeted by the component according to the invention, that is for frequencies of up to 3 MHz, such as, for example, converter switching power supplies where the switched frequencies tend to be increasingly higher. Also, the low height of the component enables a reduction in the overall thickness of the printed circuit on which it is mounted.

The body, for example made of a thermosetting epoxy resin, overmoulded directly on the coil and the connections, provides high mechanical strength, good dissipation of the losses generated by passing the current through the winding and good sealing enabling the component to be used in wet environments. The fact of not including the ferrite core in the moulding but adding it around the body, and externally apparent, improves still further the dissipation of the thermal energy generated especially by the eddy currents this thanks to direct contact of a large external surface area of the core with the exterior and the possibility of easily associating a heat sink.

According to a specific arrangement of the invention, the core consists of two elements extending respectively on each of the faces of the body, one at least of the said elements being E-shaped the centre arm of which passes through the opening of the body and the outer arms of which pass on two opposite sides of the said body. This arrangement offers, at same volume and when compared with the use of ferrite cores made in known forms, for instance a toroidal form, a much higher iron section. For an equivalent induction level, the number of turns of the winding can therefore be reduced which reduces the losses in the conducting wire and therefore enables a higher current.

This design of the ferrite cores also enables an air gap to be easily made in the magnetic circuit between the two elements comprising the core, at the level of the outer faces of at least one of the arms of the E. This air gap can be adapted for instance by playing on the respective lengths of the arms of the E. This air gap enables the core to support a high DC field and, correlatively, for a given field, a reduction in the volume of the core.

Preferably, the two elements of the core are bonded to each other when they are installed on either side of the body. The adhesive joint, made by a non-magnetic adhesive at the interface between the two elements of the core can moreover be placed in the air gap mentioned above at the level of one or more of the arms of the E. The securing of the core on the body can be completed by an additional adhesive joint placed between the edges of the elements of the core and the body, in particular, on the sides of the component.

According to another specific arrangement, the connecting terminals emerge from the body at the level of the lower face of the body, on two opposite sides of the body in relation to the said centre plane. These terminals are secured to the body by overmoulding. The outer ends of these terminals may be shaped to form pins for conventional installation on printed circuits. They will however preferably be shaped so as to form lugs extending in the plane of the lower surface of the body or slightly prominent, enabling the component to be attached to the printed circuit by the soldering of these lugs to the surface of the said circuit according to the technique known for SMCs.

The low height of the component associated with much larger transverse dimensions, especially the distance between the lugs located on each side of the component, and the low weight considerably improve the vibration resistance when the component is soldered to the circuit.

The lugs, in addition to ensuring a mechanical attachment function to the printed circuit by soldering, at least those to which the ends of the winding or windings are connected are used of course for their electrical connections. Note, on this subject, a specific advantage resulting from the SMC-type design according to the invention which lies in the large contact surface area possible between the lugs and the printed circuit which enables very low connection resistances and high currents to be obtained. This advantage is even more marked when, as can be achieved when the component includes only a single winding, this winding is connected to connections which extend along the complete length of the sides of the component.

Again, another advantage of the inductive components according to the invention is that they can be packed in strips for use by automatic installation machines, their flattened format and their low weight authorizing automatic installation by suction or by grips.

The subject of the invention is also a manufacturing process for an inductive component intended to be installed on a printed circuit and including at least one winding and a magnetic core, this process being characterized in that:

- the winding is made in the form of a flat coil by winding a wire without using a former,
- the winding is placed on a grid, the axis of the winding being perpendicular to the grid, and the ends of the wire are soldered to the said grid,
- a body made of an insulating material is overmoulded onto the assembly thus obtained to leave a central opening at the axis of the coil and leaving the edges of the grid apparent on two opposite sides of the body,
- two ferrite core elements are placed on either side of the body at least one of which is E-shaped, the centre arm of the E being inserted in the said central opening of the body and the two other arms passing on two opposite sides of the body and the two elements of the core are fixed to each other.

Preferably, the winding is made with a wire including an outer thermobonding layer and, after winding, an electric current of sufficient amperage is passed through the wire to heat it and to obtain the bonding of the turns to each other.

BRIEF DESCRIPTION OF THE DRAWINGS

Other characteristics and advantages will appear in the description which will be given of a component in compliance with the invention and its manufacturing process.

Refer to the appended drawings on which.

DETAILED DESCRIPTION OF THE PREFERRED EMBODIMENTS

Figure 1:
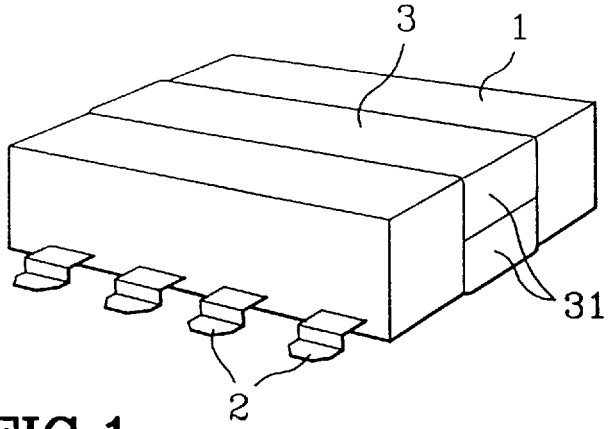
FIG. 1 shows a perspective view of an inductor in compliance with the invention.

The inductor shown on FIG. 1 includes a body 1 from which emerge, on each side, connecting lugs 2 and a ferrite magnetic core 3. The body is for example made of a thermosetting epoxy resin or of a similar material adapted for shaping by overmoulding on a winding 4 as can be seen especially on FIGS. 8 and 11. The core consists of two elements 31 with an E-shaped section placed either side of the body. The ferrite used is for example of the power ferrite type with low losses, with a utilization frequency range of 10 kHz to 5 MHz and a relative permeability of 200 to 2500 or any type of ferrite with a high relative permeability of around 3000 to 15000.

The winding 4 consists of an insulated conductive wire including a thermobonding resin coating such as for example an enameled copper wire of the Thermibond R type. This wire is wound in the form of a rectangular-shaped coil as can be seen on FIG. 5 by winding the wire on a mandrel of suitable size. The maintaining of the form of the turns and the bonding of the turns together to obtain a mechanical strength for the coil is ensured by thermobonding, by passing through the wire a calibrated electric current enabling its temperature to be raised by the Joule effect to around 180° C. to ensure the melting of the coating and the bonding of the turns after cooling. The coil can then be removed from the mandrel without distorting it. This type of winding without using a supporting former enables the overall size of the coil to be reduced to a minimum and ensures better heat dissipation during use.

Figure 4:
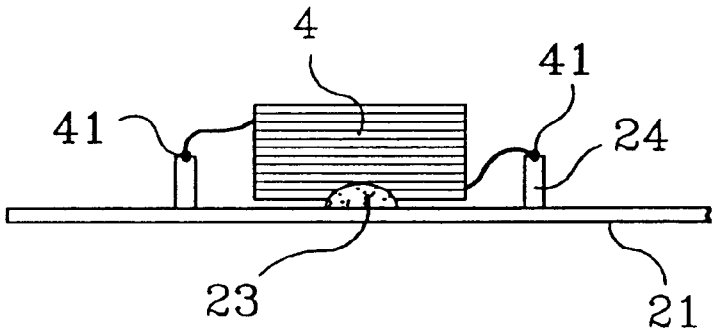
FIGS. 4 and 5 show respectively a front and top view of the installation of the winding on the grid intended to subsequently form the connecting lugs.
Figure 5:
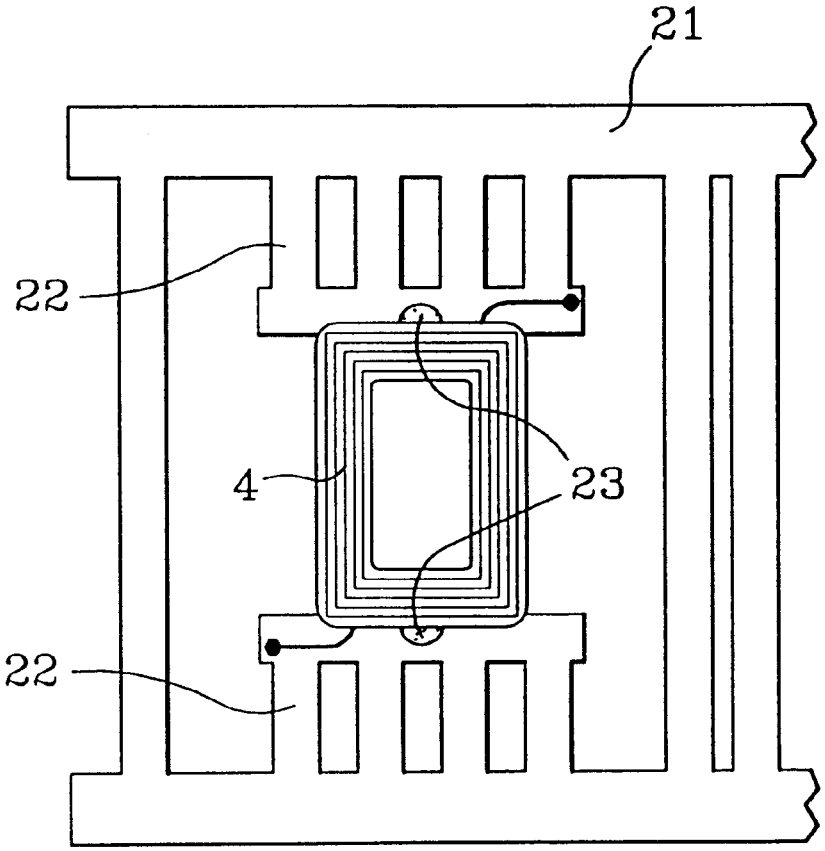

As can be seen on FIGS. 4 and 5, the winding 4 is then installed on a grid 21 made of a conductive metal, for example, a tinned copper alloy. The grid 21 is shaped so as to position the elements 22 extending on each side of the coil and intended to form the connecting lugs 2 as will be seen later. The ends 41 of the wire are soldered to the inner ends 24 of the elements 22 by adding tin at a high temperature, around 300° C., with a soldering iron or any other equivalent procedure. In the example shown, where only one coil is thus installed, the elements 22 located on the same side of the coil can be connected together. If the component includes several windings, the elements 22 would be separated, each element 22 being capable of accommodating an end of a winding. The adhesive spots 23 temporarily secure the winding to the grid.

Figure 6:
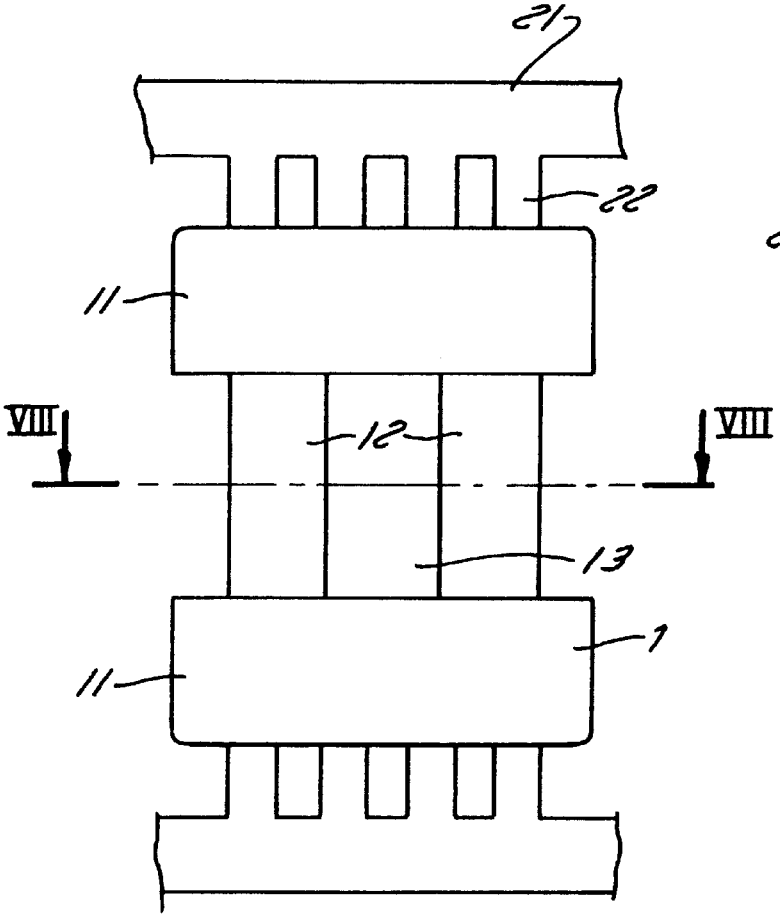
FIG. 6 shows a top view of the component after moulding the body.
Figure 7:
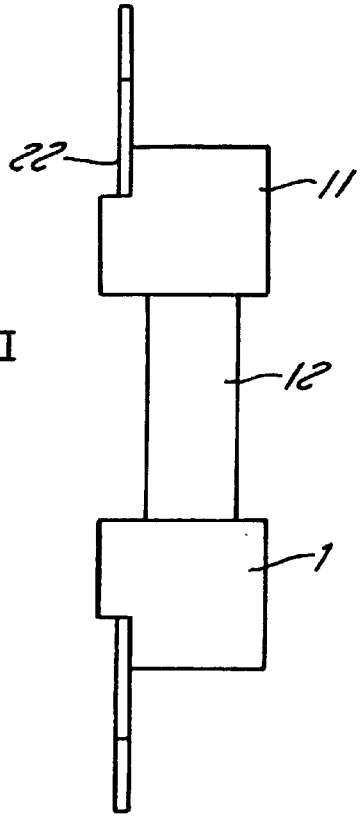
FIG. 7 shows a side view of the body.
Figure 8:
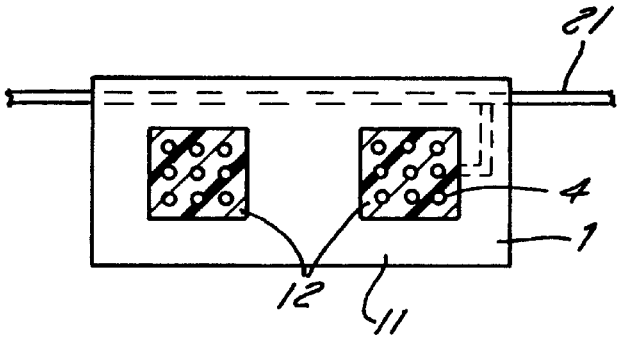
FIG. 8 shows a sectional view through line VIII—VIII of FIG. 6.
Figure 9:
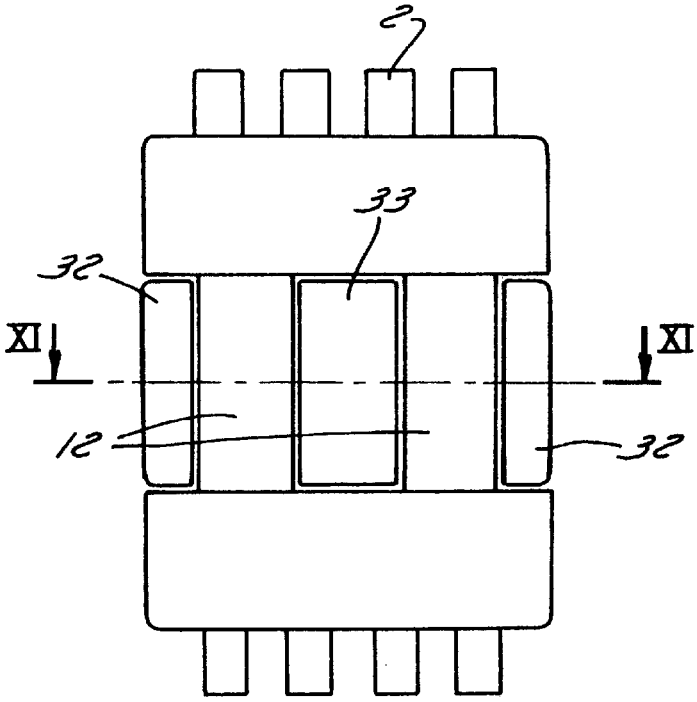
FIG. 9 shows the component after installation of one of the two core elements.

The body 1 is then overmoulded on the assembly thus obtained so as to embed the winding and the coil connections to the grid in the resin as shown on FIGS. 6 and 8 and to obtain body 1 with two lateral sections 11 located symmetrically in relation to the centre plane P and from where emerge the elements 22 of the grid and two transverse sections 12 making a central opening 13 which passes through the body in the direction of the coil axis.

Figure 10:
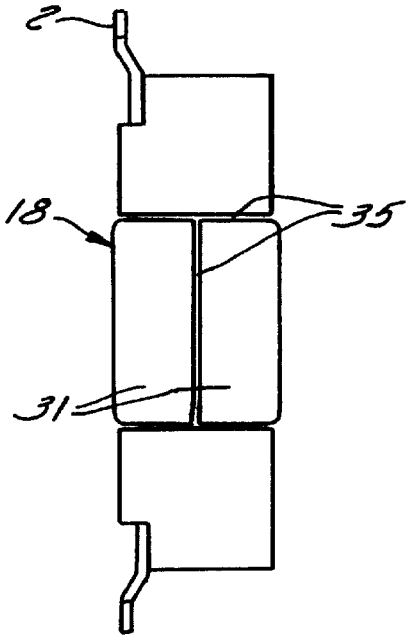
FIG. 10 shows a side view of the finished component.
Figure 11:
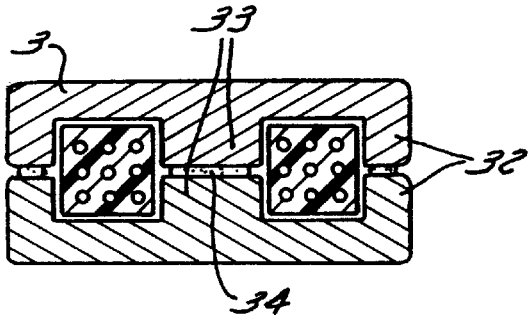
FIG. 11 shows a sectional view of the component through line XI—XI of FIG. 9, with the complete core.

The two elements 31 of the core are then placed on either side of the body as shown on FIG. 11, the outer arms 32 of the E passing on the outside of the transverse sections 12 of the body and the centre arms 33 passing through opening 13. The ferrite elements 31 are secured by layers of adhesive 34, 35 applied respectively between the end faces of the arms of the Es and on the sides between the ferrite elements and the body as shown on FIGS. 10 and 11.

Moreover, the elements 22 of the grid are cut and shaped by bending to comprise the connecting lugs 2 which extend more or less in the plane of the lower face 18 of the inductor.

Figure 2:
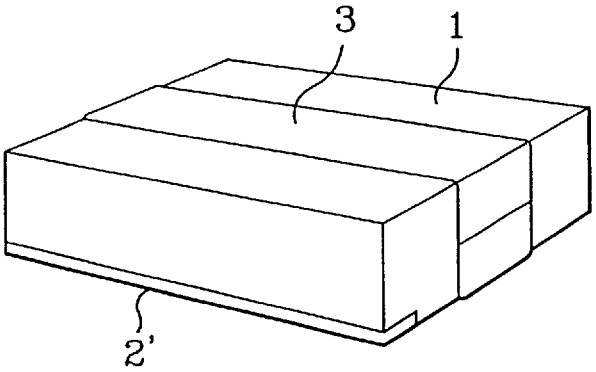
FIGS. 2 and 3 show two other design variants.

The drawing on FIG. 2 shows a design variant usable for an inductor including a single winding. The lugs 2 located on the same side are then replaced by a strip 2' which extends at the corner of the component along its complete length.

Figure 3:
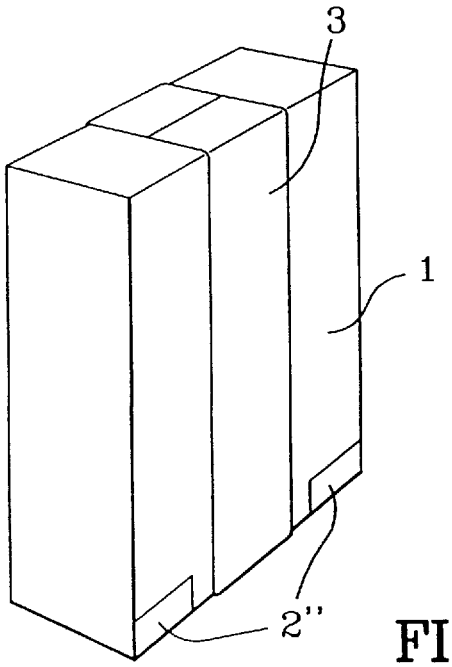

The drawing of FIG. 3 shows yet another variant where the connecting terminals 2" are made only on the edges of the lateral sections 11 of the body, such a component being especially installed perpendicular to the surface of the printed circuit.

These components can be manufactured as described above by simply adapting the shape of the grid to suit.

The invention is not limited to the designs described above only as examples. In particular, the winding could include several elements, separate or connected together, to make various types of transformers or inductors. Also, the core could be made of a single e-shaped section with longer branches and the other section being flat.

What is claimed is:

1. An inductive component intended to be installed on a printed circuit, comprising:

first and second connecting terminals for connecting the inductive component to the printed circuit, the first and second connecting terminals having inner ends;

a conductive electric wire having a first end operatively connected to the inner end of the first terminal and a second end operatively connected to the inner end of the second terminal, the wire wound about an axis to form a coil having a shape;

a coating about the wire for retaining the shape of the coil;

a body formed from a block of insulating material having a lower face orthogonal to the axis, the body being overmoulded onto the coil and onto the inner ends of the first and second terminals and defining a central opening therethrough which extends along the axis; and a magnetic core positioned between the first and second connecting terminals, the magnetic core being formed of ferrite and having a central element passing through the central opening through the body.

2. The inductive component in accordance with claim 1, characterized in that the first and second connecting terminals are coplanar with the lower face on two opposite sides of the body in relation to. the center opening therethrough.

3. The inductive component in accordance with claim 1, characterized in that the core is formed of two elements, at least one of the elements being E-shaped.

4. The inductive component in accordance with claim 3, characterized in that a magnetic air gap is made between the two elements comprising the core.

5. The inductive component in accordance with claim 3, characterized in that the two elements of the core are assembled by adhesive bonding.

6. The inductive component of claim 5 wherein the adhesive is non-magnetic.

7. The inductive component of claim 1 wherein the coating is a thermobonding resin.

* * * * *